United States Patent [19]

Hofmann et al.

[11] Patent Number: 5,048,432

[45] Date of Patent: Sep. 17, 1991

[54] PROCESS AND APPARATUS FOR THE THERMAL DECOMPOSITION OF NITROUS OXIDE

[75] Inventors: John E. Hofmann, Naperville; William H. Sun, Aurora, both of Ill.

[73] Assignee: Nalco Fuel Tech, Naperville, Ill.

[21] Appl. No.: 634,402

[22] Filed: Dec. 27, 1990

[51] Int. Cl.[5] ..... F23J 11/00; F23J 15/00

[52] U.S. Cl. ..... 110/345; 110/211; 110/212; 422/182; 423/235; 122/4 D

[58] Field of Search ..... 110/212, 213, 211, 344, 110/345; 422/182, 183; 423/235, 237; 122/4 D

[56] References Cited

U.S. PATENT DOCUMENTS

| | | | |
|---|---|---|---|
| 3,900,554 | 8/1975 | Lyon . | |
| 4,208,386 | 6/1980 | Arand et al. . | |
| 4,325,924 | 4/1982 | Arand et al. . | |
| 4,719,092 | 1/1988 | Bowers . | |
| 4,726,302 | 2/1988 | Hein et al. | 110/345 |
| 4,751,065 | 6/1988 | Bowers . | |
| 4,770,863 | 9/1988 | Epperly et al. . | |
| 4,777,024 | 10/1988 | Epperly et al. . | |
| 4,779,545 | 10/1988 | Breen et al. | 110/212 |
| 4,803,059 | 2/1989 | Sullivan et al. . | |
| 4,844,878 | 7/1989 | Epperly et al. . | |
| 4,863,704 | 9/1989 | Epperly et al. . | |
| 4,863,705 | 9/1989 | Epperly et al. . | |
| 4,873,066 | 10/1989 | Epperly et al. . | |
| 4,877,591 | 10/1989 | Epperly et al. . | |
| 4,888,165 | 12/1989 | Epperly et al. . | |
| 4,902,488 | 2/1990 | Epperly et al. . | |
| 4,927,612 | 5/1990 | Bowers . | |
| 4,997,631 | 3/1991 | Hofmann et al. . | |

FOREIGN PATENT DOCUMENTS

| | | |
|---|---|---|
| 8702025 | 4/1987 | PCT Int'l Appl. . |
| 8902780 | 4/1989 | PCT Int'l Appl. . |
| 8910182 | 11/1989 | PCT Int'l Appl. . |

*Primary Examiner*—Edward G. Favors

*Attorney, Agent, or Firm*—St. Onge Steward Johnson & Reens

[57] ABSTRACT

A process and apparatus is presented for the reduction of nitrous oxide in the effluent from the combustion of a carbonaceous fuel. The process comprises raising the temperature of the effluent to a temperature of at least about 1700° F. The apparatus utilized is a heating means which is disposed in a boiler at a location where the effluent is at a temperature of less than about 1700° F.

17 Claims, 1 Drawing Sheet

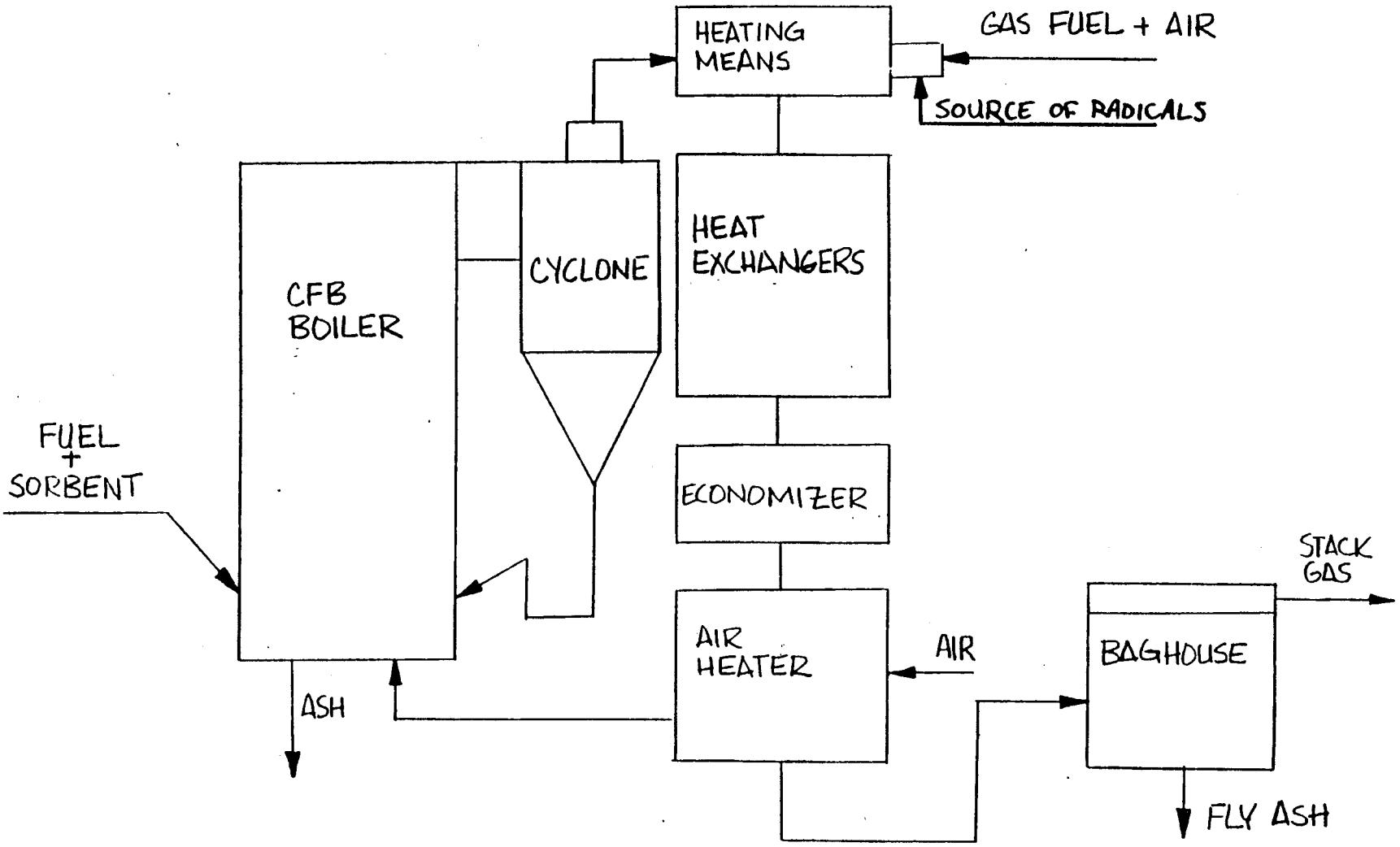
GAS FUEL + AIR
SOURCE OF RADICALS
HEATING MEANS
HEAT EXCHANGERS
ECONOMIZER
AIR HEATER
AIR
BAGHOUSE
STACK GAS
FLY ASH
CYCLONE
CFB BOILER
ASH
FUEL + SORBENT

PROCESS AND APPARATUS FOR THE THERMAL DECOMPOSITION OF NITROUS OXIDE

TECHNICAL FIELD

The present invention relates to a process for the thermal decomposition of nitrous oxide ($N_2O$) in the effluent from the combustion of a carbonaceous fuel.

In the high temperature combustion of fossil fuels, refuse, etc., the effluents produced often contain pollutants, which are released to the atmosphere. Among these are oxides of nitrogen and sulfur. A great deal of effort has been expended to carefully monitor and control the emission of these pollutants because of their role in, among other things, the generation of acid rain and photochemical smog. Although nitrous oxide is technically an oxide of nitrogen, it has been excluded from the regulatory definition of $NO_x$. The generation of $N_2O$ has not been under such intense scrutiny because it is not believed to be involved in the production of acid rain and photochemical smog. Recently, however, nitrous oxide has been identified as a contributing factor in global warming (through the "greenhouse effect") and ozone depletion in the stratosphere. Accordingly, the emission of nitrous oxide to the atmosphere is highly undesirable.

Generally, boilers which are fired using pulverized coal, oil, or gas do not produce a significant amount of $N_2O$, but circulating fluidized bed ("CFB") boilers can produce high levels of nitrous oxide. It is not unusual for the effluent from CFB boilers to contain nitrous oxide levels in excess of about 100 parts per million ("ppm"). In addition, many processes for reducing effluent nitrogen oxides ($NO_x$, where x is a positive integer) concentrations, whether from pulverized coal, oil, or gas fired boilers, or CFB boilers, utilize urea, cyanuric acid or other nitrogenous compositions. The use of such nitrogenous compounds for $NO_x$ reducing processes can often lead to the generation of additional amounts of $N_2O$ in the effluent.

In fact, it has been proposed that nitrous oxide is an intermediate in the $NO_x$ reduction pathway to $N_2$ when urea, cyanuric acid, or other nitrogen containing substances are used. It is generally believed that at temperatures below 1700° F., especially below about 1600° F., nitrous oxide which has been formed is stable, remains in the effluent, and is expelled to the atmosphere. In CFB boilers, which generally operate at temperatures below about 1600° F., the effluent is usually at a temperature at which $N_2O$ is stable and does not decompose.

Although $N_2O$ decomposition processes which utilize catalysts are known, these convert at least some of the $N_2O$ to $NO_x$. This is counterproductive since the elimination of one pollutant by the generation of another is disadvantageous. What is desired, therefore, is a process by which nitrous oxide in the effluent from the combustion of a carbonaceous fuel can be decomposed without the production of other, equally undesirable, pollutants.

BACKGROUND ART

Recently, in a unique application of a nitrogen oxides reducing process, Hofmann, Sprague, and Sun, in U.S. patent application Ser. No. 07/489,919, filed on Mar. 7, 1990, entitled "Process for Reducing Nitrogen Oxides Without Generating Nitrous Oxide", now U.S. Pat. No. 4,997,631, have disclosed a method of achieving substantial $NO_x$ reductions while minimizing the nitrous oxide produced as a result thereof. Although uniquely effective, this process does not address the nitrous oxide produced in CFB boilers when $NO_x$ reduction processes are not employed, nor with the decomposition of $N_2O$ once it is present in a boiler effluent.

DISCLOSURE OF INVENTION

The present invention relates to a process for reducing nitrous oxide in the effluent from the combustion of a carbonaceous fuel. More specifically, the inventive process comprises "reheating" the effluent to a temperature of at least about 1700° F. In a particular embodiment, the process comprises disposing a means for reheating the effluent to at least about 1700° F. in the flow path of the nitrous oxide containing effluent at a position where the effluent is at a temperature of less than about 1700° F. The present invention also relates to a boiler having such means disposed therein.

BRIEF DESCRIPTION OF THE DRAWING

The objects of this invention will be described and the present invention will be better understood and its advantages more apparent in view of the following detailed description, especially when read with reference to the appended drawing which provides a schematic illustration of a circulating fluidized bed boiler having a heating means disposed therein.

BEST MODE FOR CARRYING OUT THE INVENTION

As noted, the present invention relates to the thermal decomposition of nitrous oxide by raising the temperature of the $N_2O$ containing effluent to at least about 1700° F. Preferably, this is accomplished by disposing a heating means in the effluent flow path of a boiler, be it a CFB boiler or a pulverized coal, oil, gas, or refuse fired boiler. The effluent at the point where such means is located is at a temperature below about 1700° F., where $N_2O$ is likely to be present and stable. The inventive process is also advantageously practiced in a CFB boiler or a pulverized coal, oil, gas, or refuse fired boiler which has been treated with a nitrogenous composition to reduce the nitrogen oxides level therein.

Suitable heating means for raising the effluent temperature to at least about 1700° F. preferably comprises a burner, such as a duct burner or other type of burner, which is effective at raising the effluent temperature to the desired temperatures. In a CFB boiler this heating means, as illustrated in the attached drawing figure, is advantageously located downstream from the cyclone and upstream from the heat exchangers for maximum efficiency. In other types of boilers the heating means can be located in any area where the flue gas is below about 1700° F., more preferably below about 1600° F.

Although there is no lower limit to the effluent temperatures which exist at the location of the heating means, the lower the temperature, the more energy it will take for the heating means to raise the effluent temperature to at least about 1700° F. Accordingly, it is advantageous that the effluent temperature at the location of the heating means be no lower than about 1400° F., more advantageously no lower than about 1500° F. In this way, the energy input required by the heating means to raise the effluent temperature to at least 1700° F. is kept to a relative minimum.

In addition, the higher the temperature to which the heating means raises the effluent, the more rapid the reaction rate of the decomposition of $N_2O$ to $N_2$. Accordingly, it is desirable that the heating means raise the effluent temperature to temperatures which can be substantially greater than about 1700° F., including temperatures of about 2000° F. and higher. Because there is an energy cost in raising the effluent temperature to such high levels, it may be preferred that the effluent temperature be only raised to temperatures of at least about 1950° F. or even at least about 1850° F. in order to avoid creating an economic disadvantage in the use of the process of this invention.

The residence time of the effluent at the temperatures to which it is raised by the heating means, which in part determines the nature (i.e., type and size) of the heating means, is only that necessary to cause a substantial amount of the $N_2O$ to decompose to $N_2$. This residence time is inversely proportional to the temperature to which the heating means raises the effluent and, as would be understood by the skilled artisan, depends upon the flow rate of the effluent. Even at temperatures of about 1700° F., the residence time need not be more than about 1 second, and is generally no more than about 0.5 seconds (500 milliseconds). Advantageously, the residence time is about 200 to about 450 milliseconds.

Moreover, if the heating means is located in the effluent upstream from the heat exchangers (i.e., where the effluent is still at a relatively high temperature), as illustrated in the attached drawing figure, the heat added to the effluent by the heating means can be utilized by the heat exchangers and, consequently, is not lost.

Advantageously, the process of the present invention further involves introducing a source of hydroxyl (OH) and/or hydrogen (H) radicals into the effluent. These radicals have been found to increase the reaction rate of the decomposition of nitrous oxide to $N_2$. The introduction of the source of hydroxyl and/or hydrogen radicals should be at an effluent location at or near the heating means (downstream or, preferably, immediately upstream), and is most preferably via means integral or associated with the heating means, such as an injector positioned in the vicinity of the burner operating as the heating means.

The concentration in the effluent of the desired radicals can be increased by the addition of a source of radicals such as carbon monoxide (CO), hydrogen, or hydrocarbons, especially oxygenated hydrocarbons. Hydrogen is most preferred for this purpose due to its economy. Oxygenated hydrocarbons which are suitable as the source of hydroxyl radicals include alcohols such as methanol, aldehydes such as formaldehyde, acids such as formic acid, sugar, by which is meant virtually any saccharide or saccharide containing material, as well as other well known oxygenated hydrocarbons.

The source of hydroxyl or hydrogen radicals is introduced at a rate sufficient to provide at least about ten times the equilibrium value for the radical (at the temperature to which the effluent is being raised). More preferably, the source of radicals is introduced at a rate sufficient to provide at least about 100 times the equilibrium value for the radical. It will be recognized that the rate of introduction of the source of radicals will depend on the number of radicals expected to be provided by the particular source employed. For instance, since it is expected that a dihydric alcohol will provide twice as many hydroxyl radicals as a monohydric alcohol, a dihydric alcohol is provided at half the rate as a monohydric alcohol.

The means utilized to introduce the source of radicals can be any suitable means such as an injector. Exemplary are those disclosed by Burton in U.S. Pat. No. 4,842,834 and DeVita in U.S. Pat. No. 4,915,036. Other suitable injectors are those disclosed by Peter-Hoblyn and Grimard in International application No. PCT/EP89/00765, filed July 4, 1989, entitled "Lance-Type Injection Apparatus" and Chawla, von Bergmann, and Pachaly in U.S. patent application Ser. No. 07/526,116, entitled "Process and Apparatus for Minimizing Pollutant Concentrations in Combustion Gases", filed May 21, 1990. The disclosures of each of these is incorporated herein by reference.

An unexpected result from the use of the process of the present invention is in the fact that the thermal decomposition of nitrous oxide does not increase the effluent composition of $NO_x$, as is the case with catalytic $N_2O$ decomposition processes. This lack of $NO_x$ reduction means that there is virtually no practical limit to the level of decomposition of nitrous oxide achieved, since other pollutants are not being concurrently generated.

As noted above, and illustrated in the attached drawing figure, the present invention also relates to a boiler having a heating means disposed therein for raising the effluent temperature to at least 1700° F. Such heating means (i.e., a burner) should be located at a location where the effluent temperature is below about 1700° F., more preferably below about 1600° F. As also discussed above, it is advantageous that such heating means be disposed at a location where the effluent temperature is above about 1400° F., especially above about 1500° F. The boiler in which the heating means is disposed can be a pulverized coal, oil, or gas fired boiler or a boiler which is fired by refuse, but it is anticipated that the primary use of the present invention will be in circulating fluidized bed boilers.

Since the introduction of nitrogenous compositions, by which is meant a composition having at least one component containing nitrogen as an element thereof, for $NO_x$ reduction can lead to the generation of $N_2O$, the thermal converter should also be located downstream of any such introduction of nitrogenous compositions. The reduction of nitrogen oxides by such nitrogenous treatment agents comprises a selective, free radical-mediated process, often referred to as selective noncatalytic reduction (SNCR). Suitable nitrogenous compositions for use as a $NO_x$ reducing treatment agent include cyanuric acid, ammonia such as disclosed by Lyon in U.S. Pat. No. 3,900,554, and urea such as disclosed by Arand et al. in either of U.S. Pat. Nos. 4,208,386 and 4,325,924, the disclosures of each of which are incorporated herein by reference.

Additional appropriate nitrogenous treatment agents and methods known as being effective for the reduction of nitrogen oxides include those disclosed by International patent application entitled "Reduction of Nitrogen- and Carbon-Based Pollutants Through the Use of Urea Solutions", having Publication No. WO 87/02025, filed in the name of Bowers on Oct. 3, 1986; U.S. Pat. No. 4,751,065 in the name of Bowers; U.S. Pat. No. 4,719,092, to Bowers; U.S. Pat. No. 4,927,612, also to Bowers; U.S. Pat. No. 4,770,863 to Epperly and Sullivan; U.S. Pat. No. 4,888,165 to Epperly and Sullivan; U.S. Pat. No. 4,877,591 to Epperly and Sullivan; U.S. Pat. No. 4,803,059 to Sullivan and Epperly; U.S. Pat. No. 4,863,705 to Epperly, Sullivan, and Sprague; U.S. Pat. No. 4,844,878 to Epperly, Sullivan, and Sprague;

U.S. Pat. No. 4,770,863 to Epperly and Sullivan; International patent application entitled "Composition for Introduction into a High Temperature Environment", having Publication No. WO 89/10182, filed in the names of Epperly, Sprague, and von Harpe on Apr. 28, 1989; U.S. Pat. No. 4,902,488 to Epperly, O'Leary, Sullivan, and Sprague; U.S. Pat. No. 4,863,704 to Epperly, Peter-Hoblyn, Shulof, Jr., Sullivan, and Sprague; U.S. Pat. No. 4,873,066 to Epperly, Sullivan, and Sprague; copending and commonly assigned U.S. patent application entitled "Hybrid Process for Nitrogen Oxides Reduction", having Ser. No. 07/395,810, filed in the names of Epperly and Sprague on Aug. 18, 1989; U.S. Pat. No. 4,997,631, to Hofmann, Sprague, and Sun and copending and commonly assigned U.S patent application entitled "Process for the In-Line Hydrolysis of Urea", having Ser. No. 07/561,154, filed in the names of von Harpe and Pachaly on Aug. 1, 1990, the disclosures of each of which are incorporated herein by reference.

These patents and applications contemplate the use of treatment agents which comprise urea (or one or more of its hydrolysis products such as ammonium carbamate, ammonium carbonate, and mixtures of ammonia and ammonium bicarbonate) or ammonia (or compounds which produce ammonia as a by-product such as ammonium salts like ammonium formate and ammonium oxalate), optionally enhanced by other compositions such as hexamethylenetetramine (HMTA), oxygenated hydrocarbons such as ethylene glycol, ammonium salts of organic acids such as ammonium acetate and ammonium benzoate, heterocyclic hydrocarbons having at least one cyclic oxygen such as furfural, sugar, molasses, 5- or 6-membered heterocyclic hydrocarbons having at least one cyclic nitrogen such as pyridine and pyrolidine, hydroxy amino hydrocarbons such as milk or skimmed milk, amino acids, proteins and monoethanolamine and various other compounds which are disclosed as being effective at the reduction of nitrogen oxides in an effluent.

The use of nitrogenous compositions for $NO_x$ reduction and the thermal decomposition of $N_2O$ according to the process of the present invention can be combined into a multi-stage treatment regimen which will reduce effluent nitrogen oxides and then thermally decompose nitrous oxide generated during the $NO_x$ reduction process. Such processes are suggested in, for instance, U.S. Pat. No. 4,777,024 to Epperly, Peter-Hoblyn, Shulof, Jr., and Sullivan, as well as International patent application entitled "Multi-Stage Process for Reducing the Concentration of Pollutants in an Effluent", having Publication No. WO 89/02780, filed in the names of Epperly, Peter-Hoblyn, Shulof, Jr., and Sullivan on Aug. 12, 1988, the disclosures of each of which are incorporated herein by reference. In a first stage of such a process, $NO_x$ is reduced using a nitrogenous treatment agent as described above. In a second stage, the thermal decomposition of $N_2O$ is effected by the means described above. By doing so, the advantages of the use of nitrogenous $NO_x$-reducing agents are obtained, while avoiding the disadvantageous, and potentially limiting, emission of nitrous oxide to the atmosphere.

The use of the present invention to achieve substantial reductions in the nitrous oxide concentration of a combustion effluent is illustrated by reference to the following examples:

EXAMPLE I

The burner used is a burner having an effluent flue conduit, known as a flame tube, approximately 209 inches in length and having an internal diameter of eight inches and walls two inches thick. The burner has a flame area adjacent the effluent entry port and flue gas monitors adjacent the effluent exit port to measure the concentration of compositions including nitrous oxide, nitrogen oxides, and other compounds of interest which may be present in the effluent. The effluent flue conduit additionally has a thermocouple for temperature measurement disposed through ports in the interior at several points.

The burner is fired using No. 2 oil and a gas stream of $N_2O$ is injected into the flue conduit. Immediately downstream of the $N_2O$ entry port, a section of the flue conduit is electrically heated and controlled to a desired temperature which varies between 1600° F. and 2050° F., as noted below. Residence time for the stream of $N_2O$ in the electrically heated flue conduit section is between 300 and 400 milliseconds. Measurements of nitrous oxide at the effluent exit port are taken and compared with a calculated amount which would be expected based on flue gas flow rate and the injection rate of nitrous oxide. The results are set out in Table 1. In addition, nitrogen oxides are measured and little or no increase is found for those conditions where $N_2O$ is found to have decomposed.

TABLE 1

| Temperature (°F.) | $N_2O$ Calculated | $N_2O$ Measured | % Reduction |
|---|---|---|---|
| 1600 | 113 | 108 | 4 |
| 1700 | 113 | 108 | 4 |
| 1808 | 104 | 91 | 13 |
| 1900 | 106 | 75 | 29 |
| 1980 | 101 | 52 | 49 |
| 2050 | 101 | 32 | 68 |

EXAMPLE II

The apparatus and procedure of Example I are repeated, except that hydrogen gas is coinjected with the stream containing nitrous oxide. The results are set out below in Table 2. Again, there is found to be little or no increase in nitrogen oxides for those conditions where $N_2O$ is found to have decomposed.

TABLE 2

| Temperature (°F.) | $N_2O$ Calculated | $N_2O$ Measured | % Reduction |
|---|---|---|---|
| 1600 | 113 | 108 | 4 |
| 1700 | 113 | 108 | 4 |
| 1790 | 118 | 108 | 9 |
| 1900 | 101 | 31 | 69 |
| 1980 | 101 | 18 | 82 |

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention which is defined by the following claims.

I claim:

1. A process for the reduction of nitrous oxide in the effluent from the combustion of a carbonaceous fuel, the process comprising:

a) forming an effluent in a circulating fluidized bed boiler; and b) raising the temperature of said effluent to a temperature of at least about 1700° F., when said effluent is at a temperature below about 1700° F.

2. The process of claim 1 which comprises raising the temperature of effluent to a temperature of at least about 1850° F.

3. The process of claim 1 wherein the temperature of the effluent is raised by means of a heating means.

4. The process of claim 3 wherein said heating means comprises a burner.

5. The process of claim 1 which comprises a first stage comprising introducing into the effluent a nitrogenous treatment agent under conditions effective for the reduction of nitrogen oxides and a second stage comprising raising the effluent temperature at a location downstream from said introduction of the nitrogenous agent.

6. The process of claim 5 wherein said nitrogenous agent comprises urea, ammonia, cyanuric acid, ammonium carbamate, ammonium carbonate, mixtures of ammonia and ammonium bicarbonate, ammonium formate, or ammonium oxalate.

7. The process of claim 1 which further comprises introducing a source of hydroxyl or hydrogen radicals into the effluent at a location at or near that where the effluent temperature is raised.

8. The process of claim 7 wherein said source of hydroxyl or hydrogen radicals comprises carbon monoxide, hydrogen, or a hydrocarbon.

9. The process of claim 8 wherein said hydrocarbon is an oxygenated hydrocarbon selected from the group consisting of methanol, formaldehyde, formic acid, sugar, and mixtures thereof.

10. A boiler consisting of a circulating fluidized bed boiler comprising an effluent flow path in which is disposed a heating means for raising the effluent temperature to at least about 1700° F., said heating means located where the effluent temperature is less than about 1700° F.

11. The boiler of claim 10 wherein said heating means comprises a burner which is disposed in the boiler at a location where the effluent temperature is less than about 1700° F.

12. The boiler of claim 11 wherein said burner is disposed between the cyclone and the heat exchangers of said circulating fluidized bed boiler.

13. The boiler of claim 10 which further comprises an introducing means for introducing a source of hydroxyl or hydrogen radicals into the effluent.

14. The boiler of claim 13 wherein said introducing means comprises an injector.

15. The boiler of claim 13 wherein said introducing means is disposed in the boiler at or near said heating means.

16. The boiler of claim 10 which further comprises a reducing means for introducing into the effluent a nitrogenous treatment agent under conditions effective for the reduction of nitrous oxides.

17. The boiler of claim 16 wherein said heating means for raising the temperature of the effluent is located downstream from said reducing means for introducing a nitrogenous treatment agent.

* * * * *

US005048432B1

REEXAMINATION CERTIFICATE (2942th)

United States Patent [19]

[11] B1 5,048,432

Hofmann et al.

[45] Certificate Issued Jul. 2, 1996

[54] PROCESS AND APPARATUS FOR THE THERMAL DECOMPOSITION OF NITROUS OXIDE

[75] Inventors: John E. Hofmann, Naperville; William H. Sun, Aurora, both of Ill.

[73] Assignee: Nalco Fuel Tech, Naperville, Ill.

Reexamination Request:
No. 90/002,629, Feb. 18, 1992

Reexamination Certificate for:

| | |
|---|---|
| Patent No.: | **5,048,432** |
| Issued: | **Sep. 17, 1991** |
| Appl. No.: | **634,402** |
| Filed: | **Dec. 27, 1990** |

[51] Int. Cl.[6] ..... F23J 11/00; F23J 15/00

[52] U.S. Cl. ..... 110/345; 110/211; 110/212; 422/182; 423/235; 122/4 D

[58] Field of Search ..... 110/212, 213, 110/211, 345, 344; 422/182, 183; 423/235, 237, 239, 239 A; 122/4 D

[56] References Cited

U.S. PATENT DOCUMENTS

| | | | |
|---|---|---|---|
| 5,043,150 | 8/1991 | Hiltunen et al. | 423/239 |
| 5,441,714 | 8/1995 | Oakes et al. | 423/235 |

*Primary Examiner*—Henry A. Bennett

[57] ABSTRACT

A process and apparatus is presented for the reduction of nitrous oxide in the effluent from the combustion of a carbonaceous fuel. The process comprises raising the temperature of the effluent to a temperature of at least about 1700° F. The apparatus utilized is a heating means which is disposed in a boiler at a location where the effluent is at a temperature of less than about 1700° F.

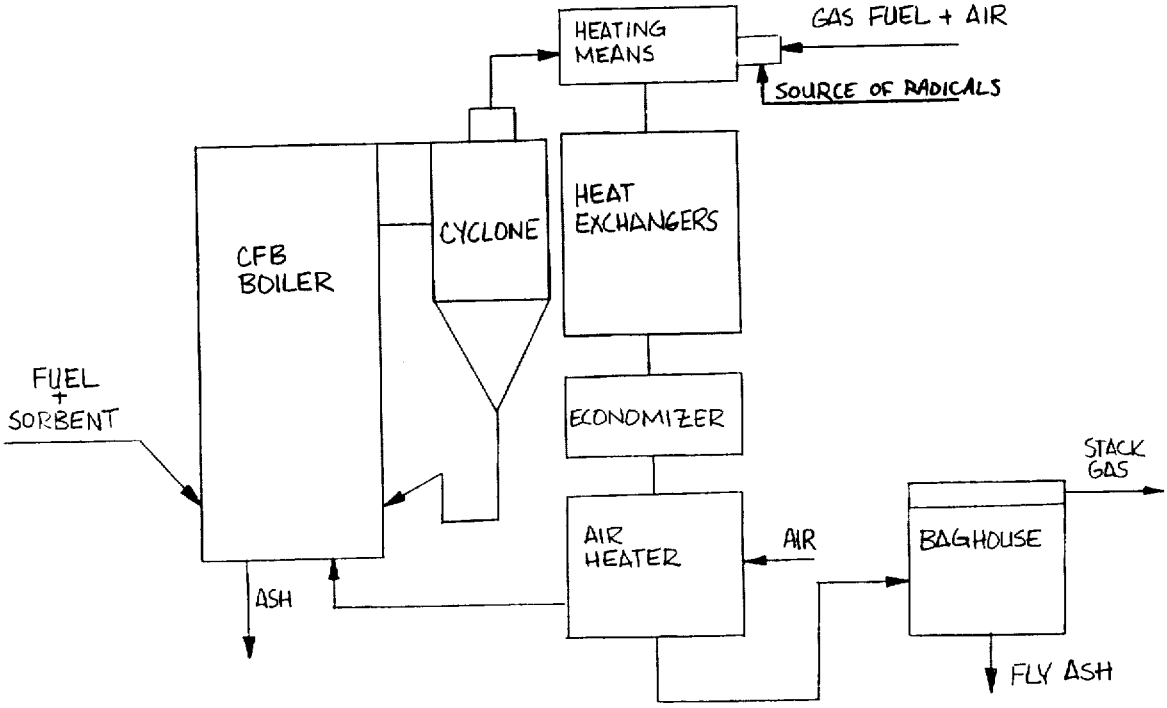

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 3, 4, 11 and 16 are cancelled.

Claims 1, 10, 12, 15 and 17 are determined to be patentable as amended.

Claims 2, 5–9, 13 and 14, dependent on an amended claim, are determined to be patentable.

1. A process for the reduction of nitrous oxide in the effluent from the combustion of a carbonaceous fuel, the process comprising:

a) forming an effluent in a circulating fluidized bed boiler *by combustion of a carbonaceous fuel*; and b) raising the temperature of said effluent to a temperature of at least about 1700° F. *by burning a fuel by means of a burner*, when said effluent is at a temperature below about 1700° F.

10. A boiler consisting of a circulating fluidized bed boiler comprising an effluent flow path in which is disposed *a reducing means for introducing into the effluent a nitrogenous treatment agent under conditions effective for the reduction of nitrogen oxides*, and a heating means *comprising a burner* for raising the effluent temperature to at least about 1700° F., said [heating means] *burner* located where the effluent temperature is less than about 1700° F.

12. The boiler of claim [11] *10* wherein said burner is disposed between the cyclone and the heat exchangers of said circulating fluidized bed boiler.

15. The boiler of claim 13 wherein said introducing means is disposed in the boiler at or near said [heating means] *burner*.

17. The boiler of claim [16] *10* wherein said heating means for raising the temperature of the effluent is located downstream from said reducing means for introducing a nitrogenous treatment agent.

* * * * *